US008141560B2

(12) United States Patent
Toba

(10) Patent No.: US 8,141,560 B2
(45) Date of Patent: Mar. 27, 2012

(54) APPARATUS FOR FIXING A WIG AND METHOD FOR FIXING A WIG USING THE APPARATUS

(75) Inventor: Mayumi Toba, Tokyo (JP)

(73) Assignee: Aderans Holdings Co., Ltd., Tokyo (JP)

( * ) Notice: Subject to any disclaimer, the term of this patent is extended or adjusted under 35 U.S.C. 154(b) by 220 days.

(21) Appl. No.: 12/602,402

(22) PCT Filed: May 23, 2008

(86) PCT No.: PCT/JP2008/059580

§ 371 (c)(1),
(2), (4) Date: Jan. 8, 2010

(87) PCT Pub. No.: WO2008/149697

PCT Pub. Date: Dec. 11, 2008

(65) Prior Publication Data

US 2010/0170527 A1 Jul. 8, 2010

(30) Foreign Application Priority Data

May 30, 2007 (JP) ..... 2007-143433

(51) Int. Cl.

| | |
|---|---|
| ***A41G 3/00*** | (2006.01) |
| ***A41G 5/00*** | (2006.01) |
| ***B32B 3/06*** | (2006.01) |
| ***B32B 5/02*** | (2006.01) |
| ***B32B 27/04*** | (2006.01) |
| ***B32B 27/12*** | (2006.01) |
| ***A44B 1/04*** | (2006.01) |
| ***A44B 11/25*** | (2006.01) |
| ***A44B 17/00*** | (2006.01) |
| ***A44B 18/00*** | (2006.01) |

(52) U.S. Cl. ..... 132/201; 132/53; 428/100; 442/43; 442/149; 24/304; 24/306

(58) Field of Classification Search ..... 132/53–56, 132/200, 201, 273, 274, 270, 212, 106, 220, 132/221, 223, 245; 446/394; 156/383, 152, 156/307.7; 428/343, 40.1, 40.2, 419, 42.2, 428/141, 100; 442/43, 149; 128/DIG. 15; 24/304, 306; 623/15.11
See application file for complete search history.

(56) References Cited

U.S. PATENT DOCUMENTS 3,662,766 A * 5/1972 Maassen et al. ..... 132/201
(Continued)

FOREIGN PATENT DOCUMENTS

JP 5-27017 4/1993
(Continued)

OTHER PUBLICATIONS

International Preliminary Report on Patentability issued Jan. 21, 2010 in International (PCT) Application No. PCT/JP2008/059580.

(Continued)

*Primary Examiner* — Todd Manahan
*Assistant Examiner* — Vanitha Elgart
(74) *Attorney, Agent, or Firm* — Wenderoth, Lind & Ponack, L.L.P.

(57) ABSTRACT

An apparatus for fixing a wig to head of a user, including a flexible plane sheet including a first opening and a second opening, a plurality of monofilaments each including a swollen head and protrusively provided on a first side of the flexible plane sheet, a first adhesive layer provided so as to cover the monofilaments, a net member provided on a second side of the flexible plane sheet, and a second adhesive layer provided on the net member of a first half area, the flexible plane sheet being divided into the first half area and a second half area by a line bisecting the flexible plane sheet.

4 Claims, 7 Drawing Sheets

U.S. PATENT DOCUMENTS

| | | | | |
|---|---|---|---|---|
| 3,724,470 | A * | 4/1973 | Wilson | 132/212 |
| 4,198,734 | A * | 4/1980 | Brumlik | 24/449 |
| 4,239,829 | A * | 12/1980 | Cohen | 428/86 |
| 4,453,555 | A * | 6/1984 | Finamore | 132/53 |
| 4,738,662 | A * | 4/1988 | Kalt et al. | 604/180 |
| 5,221,276 | A * | 6/1993 | Battrell | 604/389 |
| 5,456,963 | A * | 10/1995 | Bettanny | 428/100 |
| 5,522,408 | A * | 6/1996 | Wiegner | 132/262 |
| 5,636,414 | A * | 6/1997 | Litchholt | 24/304 |
| 5,660,192 | A * | 8/1997 | Kim | 132/237 |
| 5,662,128 | A * | 9/1997 | Habibi | 132/210 |
| 5,799,669 | A * | 9/1998 | Briggs | 132/208 |
| 5,992,424 | A * | 11/1999 | Repsha et al. | 132/201 |
| 6,012,460 | A * | 1/2000 | Kikuchi | 132/53 |
| 6,267,118 | B1 | 7/2001 | Ito et al. | |
| 6,393,673 | B1 * | 5/2002 | Kourtidis et al. | 24/304 |
| 6,701,580 | B1 * | 3/2004 | Bandyopadhyay | 24/16 R |
| 7,343,921 | B2 * | 3/2008 | Salinas | 132/201 |
| 7,909,041 | B2 * | 3/2011 | Yoneda et al. | 132/53 |
| 2001/0051482 | A1 * | 12/2001 | Himmelsbach et al. | 442/151 |
| 2008/0190442 | A1 * | 8/2008 | Kwak | 132/273 |
| 2009/0126753 | A1 * | 5/2009 | Sugai et al. | 132/201 |
| 2010/0170524 | A1 * | 7/2010 | Kimura | 132/54 |
| 2011/0197908 | A1 * | 8/2011 | Waters | 132/201 |

FOREIGN PATENT DOCUMENTS

| | | |
|---|---|---|
| JP | 11-131315 | 5/1999 |
| JP | 3134280 | 7/2007 |
| WO | 99/48394 | 9/1999 |

OTHER PUBLICATIONS

International Search Report issued Sep. 2, 2008 in International (PCT) Application No. PCT/JP2008/059580.

* cited by examiner

APPARATUS FOR FIXING A WIG AND METHOD FOR FIXING A WIG USING THE APPARATUS

TECHNICAL FIELD

The present invention relates to an apparatus for fixing a wig having artificial hair transplanted to the head of a user and a method for fixing a wig using the apparatus.

BACKGROUND ART

There are known a wig stopper configured so that a clip having many pins arranged in a comb-teeth fashion is attached into an interior of a wig and so that the user's natural hairs are pinched between the pins (Patent document 1), and a wig attachment method including forming a base into which user's natural hairs are braided, putting the wig on the head, and sewing the base to a periphery of the wig (Patent document 2).

However, the method of pinching user's natural hairs by the clip having the pins arranged in a comb-teeth fashion as disclosed in Patent document 1 has the following problems. Although the wig is easy to wear or take off, the wig tends to slip out of place because of a weak holding force. Furthermore, while a user is asleep, the clip strikes against the user's head to make the user feel pain. Due to this, it is inappropriate to use the wig for long time. Moreover, the method of braiding user's natural hair into the base as disclosed in Patent document 2 has the following problems. Because of a strong fixing force, it is appropriate to use the wig for long time. However, it takes long time to wear or take off the wig and to braid user's natural hair into the base, so that the user is restrained for long time.

To solve these problems, there are proposed an apparatus for fixing a wig and an attachment method using the apparatus (Patent document 3). Namely, the apparatus configured so that an adhesive layer is bonded onto a net member and so that penetrating holes are formed to penetrate through the net member and the adhesive layer is bonded to a peripheral portion on a rear surface of a user's natural hair is penetrated through the holes of the apparatus and fixed by being held between the user's head and a side of the fixing apparatus onto which side the adhesive layer is bonded. Furthermore, there is proposed a wig fixing tool fixing a male sheet constituting a surface fastener together with a female sheet to the head of a user, putting the wig having the female sheet attached to an interior of the wig on the user's head, and uniting the male and female sheets together, thereby fixing the wig to the user's head (Patent document 4).

However, the technique disclosed in Patent document 3 has the following problems. Since the adhesive layer is not in direct contact with the scalp, such problems as itching because it gets hot and stuffy or pain at the time of taking off the wig do not occur. Nevertheless, since user's natural hair is penetrated through the penetrating holes of the apparatus and fixed only by the adhesive layer that is made of a double-side tape, a force of fixing the user's natural hair is weak. Moreover, since the adhesive layer that does not hold the user's natural hair has high adhesiveness, parts of the adhesive layer are bonded together when the apparatus is detached, making it difficult to take off the wig. If the user puts forth out his or her strength, the wig is damaged or the scalp or hair of the user is possibly strained. Furthermore, the technique disclosed in Patent document 4 has the following problems. A fixing force of joining the male sheet and the female sheet of the surface fastener together is weak and the female sheet deteriorates faster than the male sheet. Due to this, if the female sheet is joined with the male sheet, then the joined sheets become thick, the wig is floated while wearing the wig, and the user who wears the wig appears unnatural.

Patent document: Japanese Patent Application Laid-Open No. 2000-256911

Patent document: Japanese Patent Application Laid-Open No. 2004-277903

Patent document: International Publication No. WO99/48394

Patent document: Japanese Patent Application Laid-Open No. 2005-179836

DISCLOSURE OF THE INVENTION

Problem that the Invention is to Solve

It is, therefore, an object of the present invention to provide an apparatus for fixing a wig that enables a user to wear a wig easily and surely and that is easy to detach while solving the problems of loss of hair and pain in the user's head, and a method for fixing a wig using this fixing apparatus.

Means to Solve Problems

According to a first aspect of the present invention, there is provided an apparatus for fixing a wig to head of a user, comprising a flexible plane sheet having a first opening and a second opening, a plurality of monofilaments protrusively provided on a first side of the flexible plane sheet, each having a swollen head, a first adhesive layer provided on the monofilaments, a net member provided on a second side of the flexible plane sheet, and a second adhesive layer provided on the net member in substantially a whole range of a first half area sectioned by a line bisecting the flexible plane sheet, wherein the first opening is provided on the line so that a part of natural hair of the user passes through the first opening, and the second opening is provided at a predetermined position in a second half area sectioned by the line so that other part of the natural hair of the user passes through the second opening.

According to the one aspect of the present invention, each of the first opening and the second opening may be a long hole having a length in the direction of the line, and the second opening may be set to be smaller in size than the first opening. Furthermore, the first adhesive layer can be provided in substantially the whole range of the first half area and a predetermined range surrounding the second opening.

According to a second aspect of the present invention, there is provided a method for fixing a wig including a wig base and artificial hair to head of a user using the apparatus according to the first aspect of the present invention, the method comprising the steps of attaching a plurality of the apparatus to the wig by bonding each of the apparatus via the second adhesive layer to a predetermined position on a rear surface of the wig base, pulling out a part of natural hair of the user through the first opening from the second side toward the first side of the flexible plane sheet, pulling out other part of the natural hair of the user through the second opening from the second side toward the first side of the flexible plane sheet, and overlapping the first half area and the second half area with each other while the part and the other part of natural hair are held between the first half area and the second half area by folding one of the first half area and the second half area to the other in the direction of the first side, whereby the part and the other part of natural hair get entangled with each other and are engaged between the plurality of monofilaments on the first half area and the second half area, and this engaged state is kept by an adhesive force of the first adhesive layer.

A plurality of apparatus according to the present invention is bonded onto predetermined positions on a rear surface of the wig base via the second adhesive layer, respectively. In this state, only the first half area of the apparatus is fixed to the wig base and the second half area is free relative to the wig. Next, after putting the wig on the user's head at a predetermined position with a plurality of apparatus fixed to the predetermined positions of the wig base, respectively, a tappet that is a tool passes through the first opening of each apparatus from the first side of the flexible plane sheet of the apparatus. A part of the user's natural hair right under the first opening is caught up in a tip end of the tappet on the second side of the flexible plane sheet. By pulling back the tappet, a part of the user's natural hair is pulled out from the first opening toward the first side of the flexible plane sheet. Likewise, the tappet passes through the second opening of each apparatus from the first side of the flexible plane sheet. The other part of the user's natural hair is caught up in the tip end of the tappet on the second side of the flexible plane sheet, and the tappet is pulled back, thereby pulling out the other part of the user's natural hair from the second opening toward the first side of the flexible plane sheet.

One of the first half area and the second half area of each apparatus is bent toward the other half area at a line bisecting the apparatus and the first half area is overlapped with the second half area while holding the parts of the user's natural hair pulled out from the first opening and the second opening, respectively, between the first half area and the second half area. The monofilaments on the first half area, the monofilaments on the second half area, and the parts of the user's natural hair are entangled with and caught up in one another and attached to one another in an engageable fashion by the overlapping. Further, the first adhesive layer is entangled with the monofilaments and the parts of the user's hair attached to one another in the engageable fashion, thereby fixing the wig to the user's head. In this manner, the apparatus is folded double to overlap the first half area with the second half area. Due to this, an area of the apparatus folded double is about the half of that before the apparatus is folded double. Besides, in this state, the first opening is located at a position at which the apparatus is bent.

If the first half area and the second half area of each apparatus are to be overlapped with each other, many monofilaments provided on the first side of the flexible plane sheet face one another and are inserted deep into one another while breaking through the first adhesive layer located on the monofilaments. These monofilaments are entangled with the parts of the user's natural hair pulled out from the first opening and the second opening toward between the first half area and the second half area while holding the parts between the monofilaments. Further, the monofilaments are caught up in the other monofilaments and the parts of the user's natural hair. As a result, the anchoring effect of making it difficult to pull out the parts is produced, thereby keeping a tangling state. Moreover, the first adhesive layer enters between the monofilaments and the parts of the user's natural hair thus caught up in one another. The adhesive force of the first adhesive layer produces a synergic effect of increasing the states in which they are entangled and caught in one another. Thus, an overlapping state in which the first half area and the second half area are overlapped with each other is maintained, that is, the parts of the user's natural hair pulled out between the both half areas are firmly held.

Each of the first opening and the second opening according to the present invention is formed into a long hole having a length in a direction of the line bisecting the flexible plane sheet. This can facilitate an operation for catching the parts of the user's natural hair up in the tappet and pulling out the parts toward the first side of the flexible plane sheet despite relatively small occupation areas of the first opening and the second opening. However, the first opening and the second opening are not necessarily limited to long holes but may have another shape such as a large circular shape, an elliptical shape or a rectangular shape so as to give a clearance for the operation. In short, the first opening and the second opening may be formed into any shape capable of pulling out the parts of the user's natural hair.

Preferably, the second opening is set smaller in size than the first opening. The relationship between the first opening and the second opening will now be described. With the configuration of the apparatus according to the present invention, the user's natural hair used to secure the fixing force of fixing the wig to the user's head is mainly that pulled out from the first opening. However, if the apparatus 1 is folded double after the user's natural hair is pulled out from the first opening, the first opening is located at one side edge of the apparatus 1 that is being folded double. Since there is no connection of the user's natural hair with the other portions of the apparatus, the head and the apparatus are in a state in which they are not closely attached to each other on plane. Due to this, the second opening is provided on the second half area when the apparatus is folded double and a part of the user's natural hair different from that pulled out from the first opening is pulled out, whereby the user's head and the apparatus are fixed to each other at two positions and it is possible to prevent the wig from floating and being turned up. In this case, an amount of the user's natural hair pulled out from the second opening may be smaller than that pulled out from the first opening, so that the second opening may be smaller in size than the first opening.

Moreover, the first adhesive layer is arranged almost entirely on the first half area of the flexible plane sheet but is not arranged on the second half area thereof except for a predetermined range surrounding the second opening. The adhesive force is, therefore, weaker in portions in which the first adhesive layer is not arranged. Therefore, if the wig is to be detached from the user's head, the first half area and the second half area overlapped with each other can be separated using the weak adhesive force portions.

Effect of the Invention

In the apparatus according to the present invention, the monofilaments facing each other by folding the flexible plane sheet double to overlap the first half area with the second half area are entangled with, caught up in, and hardly pulled out from the parts of the user's natural hair pulled out from the first and second openings toward between the first half area and the second half area while holding the parts between the monofilaments. Namely, the apparatus according to the present invention produces the anchoring effect, thereby keeping the tangling state. Therefore, the user's natural hair pulled out between the first half area and the second half area can be firmly held. Besides, the first adhesive layer enters between the monofilaments and the user's natural hair thus entangled with and caught up in each other, and an adhesive force of the first adhesive layer produces the synergic effect of increasing the states in which they are entangled with and caught up in each other. The user's hair pulled out between the first half area and the second half area is firmly held and a good wig wearing state is kept. Further, since many monofilaments are protrusively provided, the surface of the first side of the flexible plane sheet is roughened, thereby reducing load required for release. Due to this, if the wig is to be detached from the user's head, an operation for detaching the apparatus is simplified. This can eliminate loss of the user's hair pulled out onto the flexible plane sheet and the pain in the user's head, and lessen the burden of the user.

Furthermore, the first opening for pulling out the user's natural hair is provided at the position at which the apparatus is bent and the user's natural hair right under the first opening is pulled out. Due to this, the user's natural hair is not pulled strongly according to active movement of the user's head and the pain in the user's head can be lessened. Furthermore, the second opening is provided on the second half area of the apparatus and the user's natural hair is also pulled out from the second opening. By providing the second opening as well as the first opening, the wig is suppressed from floating or being turned up between the wig and the apparatus, and the user can wear the wig more stably. Besides, the wig can easily follow movement of the user's head, so that the pain in the head can be minimized even if the user's natural hair is pulled.

EXPLANATION OF REFERENCE NUMBERS

| | |
|---|---|
| 1 | Apparatus for fixing a wig |
| 2 | Flexible plane sheet |
| 3 | Monofilament |
| 3a | Stalk of monofilament |
| 3b | Head of monofilament |
| 4a, 4b | First adhesive layer |
| 5 | net member |
| 6 | Second adhesive layer |
| 7a, 7b, 7c | Release sheet |
| 8 | First opening |
| 9 | Second opening |
| 10a | Non-adhesive layer portions |
| 20 | Natural hair |
| 20a | Part of natural hair |
| 20b | Other pert of natural hair |

BEST MODE FOR CARRYING OUT THE INVENTION

Figure 1:
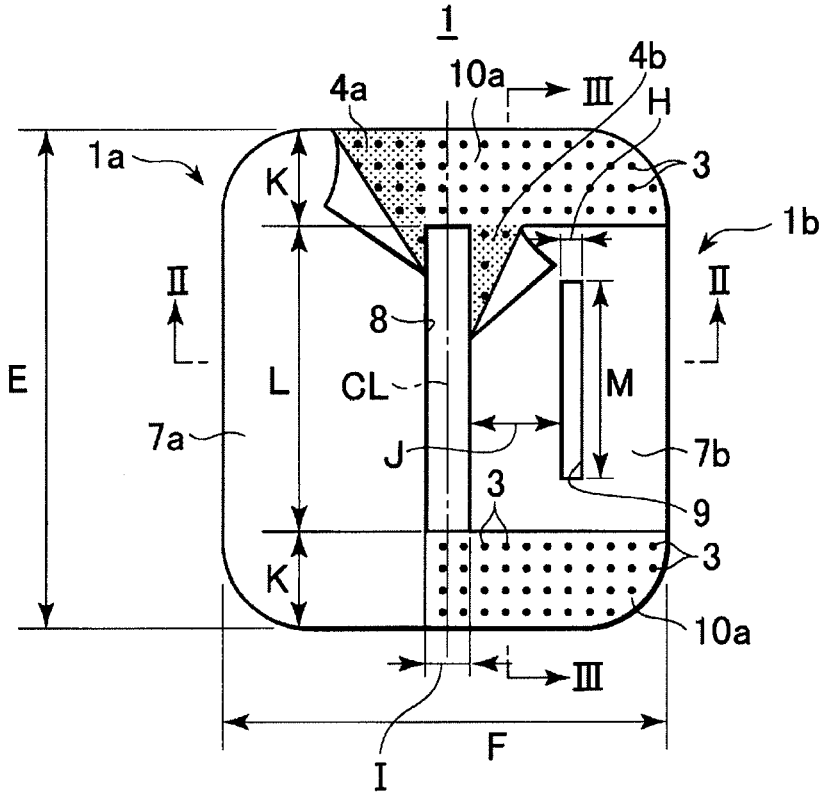
FIG. 1 is a plan view of an apparatus for fixing a wig according to an embodiment of the present invention.
Figure 2:
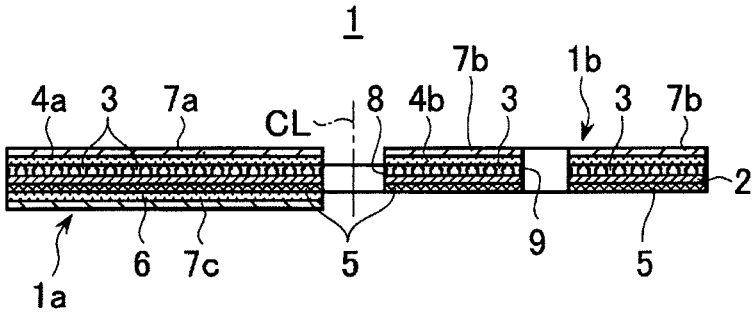
FIG. 2 is a cross-sectional view taken along a line II-II of FIG. 1 according to the embodiment of the present invention.
Figure 3:
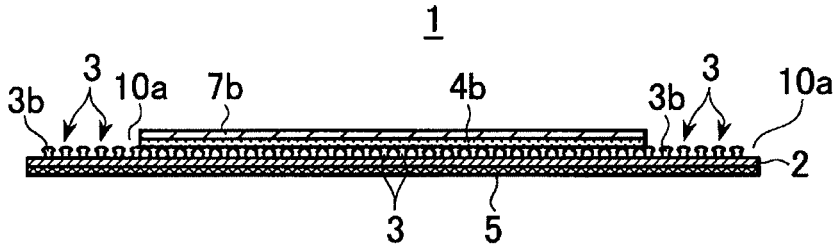
FIG. 3 is a cross-sectional view taken along a line III-III of FIG. 1 according to the embodiment of the present invention.
Figure 12:
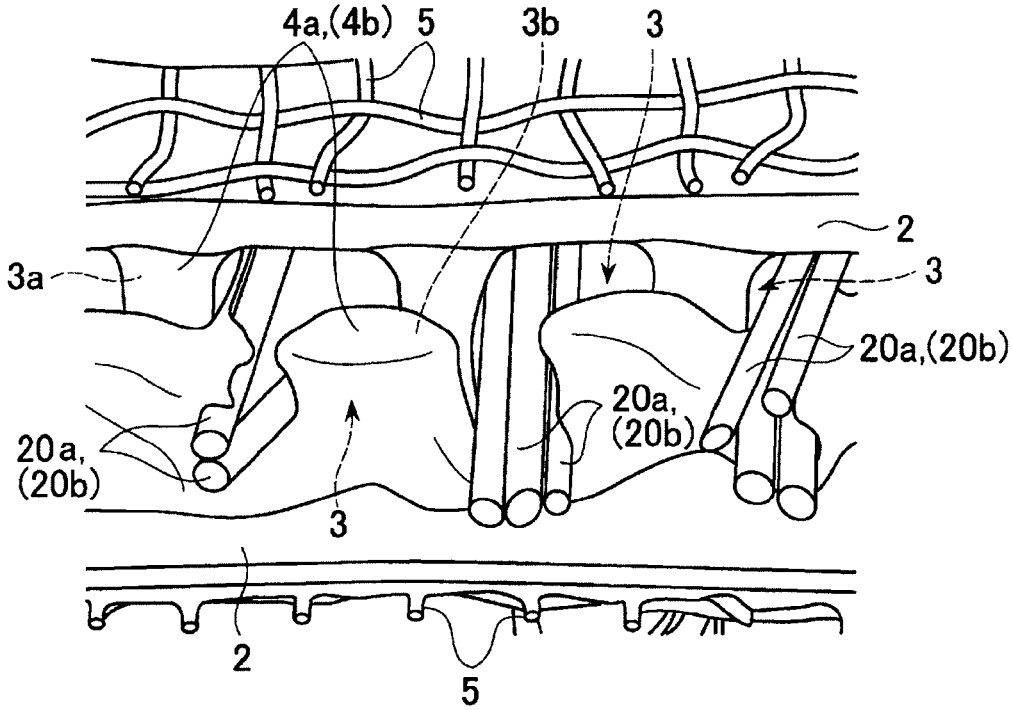
FIG. 12 is a detailed cross-sectional view of the apparatus according to the embodiment of the present invention while the user wears the wig.
Figure 13:
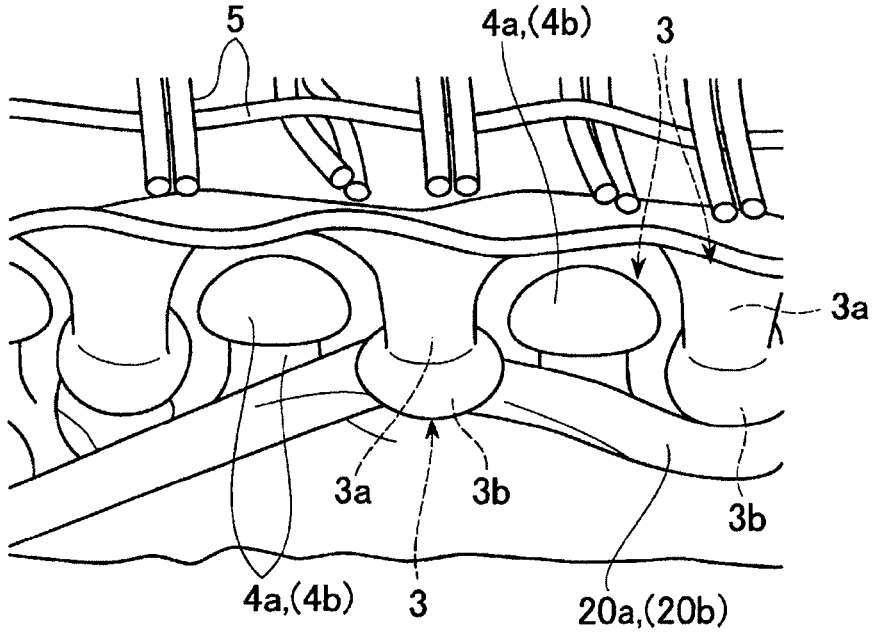
FIG. 13 is a detailed cross-sectional view of the apparatus according to the embodiment of the present invention while the user wears the wig.
Figure 14:
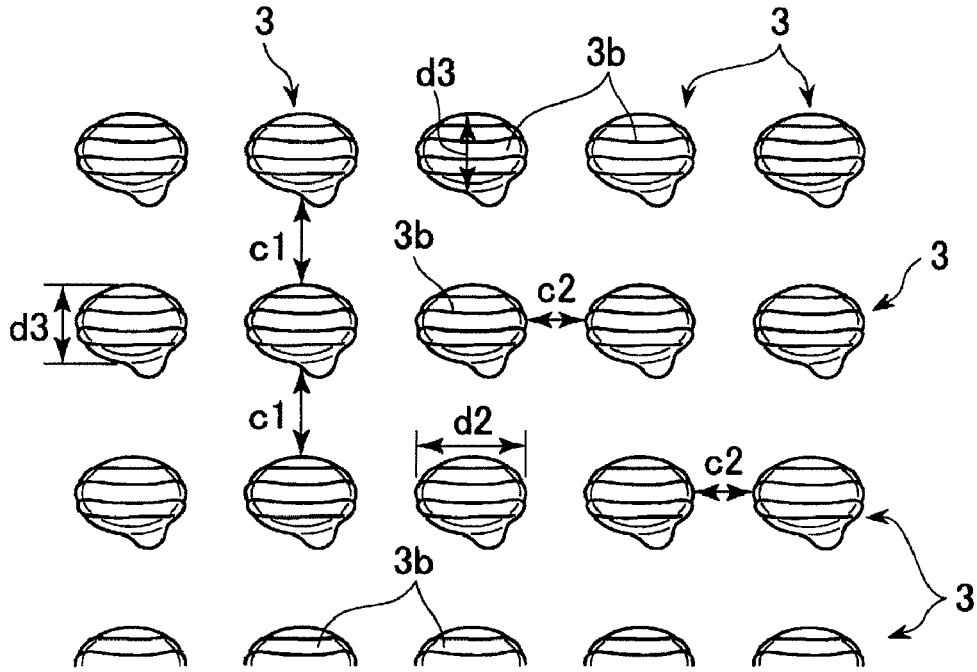
FIG. 14 is an enlarged plan view of monofilaments of the apparatus according to the embodiment of the present invention.

A most preferred embodiment of the present invention will be described hereinafter with reference to FIGS. 1 to 15. FIG. 1 is a plan view of an apparatus for fixing a wig according to the embodiment, FIG. 2 is a cross-sectional view taken along a line II-II of FIG. 1, and FIG. 3 is a cross-sectional view taken along a line III-III of FIG. 1. FIGS. 4 to 11 are explanatory views of procedures of attaching a wig to the user's head using the apparatus. FIGS. 12 and 13 are detailed cross-sectional views of the apparatus while the user wears the wig. FIG. 14 is an enlarged plan view of monofilaments of the apparatus and FIG. 15 is an enlarged perspective view of the monofilaments of the apparatus.

(Configuration)

As shown in FIGS. 1 to 3, an apparatus 1 for fixing a wig is configured so that many monofilaments 3 and two first adhesive layers 4*a*, 4*b* are arranged on a first side of a flexible plane sheet 2 cut into a rectangular shape, and a net member 5 and a second adhesive layer 6 are arranged on a second side of the flexible plane sheet 2. Release sheets 7*a*, 7*b*, and 7*c* are adhesively bonded on the first adhesive layers 4*a*, 4*b* and the second adhesive layer 6, respectively. A first opening 8 is formed on a centerline CL bisecting the apparatus 1 into a first half area 1*a* and a second half area 1*b*, and a second opening 9 is formed almost at the center of the second half area 1*b*.

Figure 15:
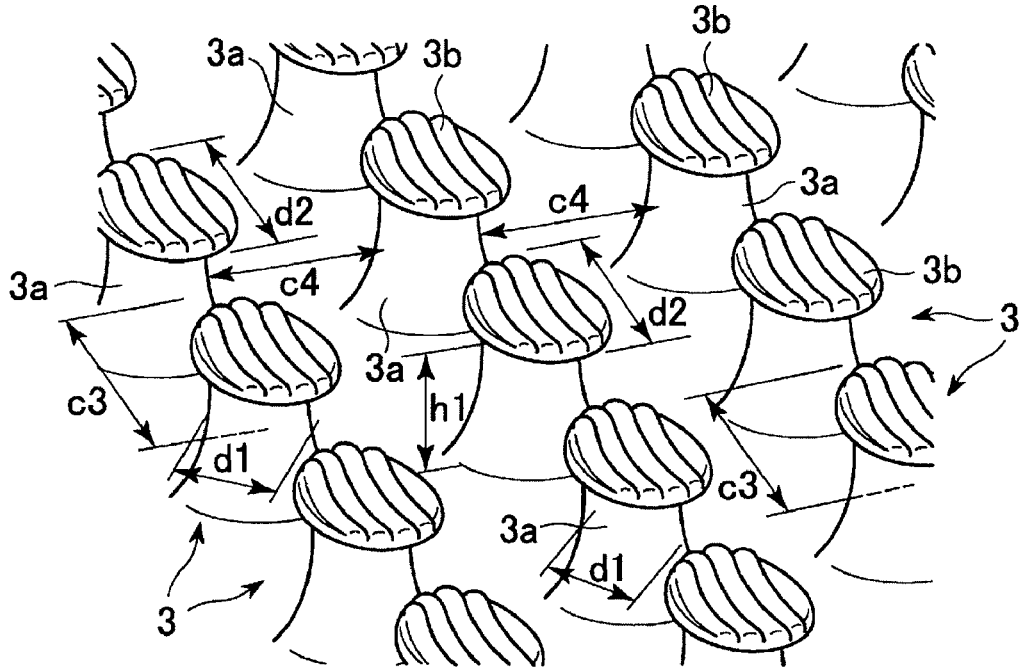
FIG. 15 is an enlarged perspective view of the monofilaments of the apparatus according to the embodiment of the present invention.

As shown in FIGS. 14 and 15 in detail, each of the monofilaments 3 includes a stalk 3*a* rising from the first side of the flexible plane sheet 2 and a head 3*b* formed on a tip end of the stalk 3*a*, projected flat laterally, and having a shape like an oyster mushroom. Many monofilaments 3 are arranged on the entire first side of the flexible plane sheet 2 except for the first opening 8 and the second opening 9. While the flexible plane sheet 2 is made of synthetic resin such as nylon, the monofilaments 3 are made of synthetic resin of the same quality as that of the sheet 2 or of a different quality therefrom such as polypropylene. The monofilaments 3 are flexible so as to be able to be bent entirely sideways if an external force acts on the monofilaments 3 from a direction of the heads 3*b*.

By projecting the heads 3*b* of the monofilaments 3 as stated above, an anchoring effect can be obtained. Namely, user's natural hair 20 is easily caught up in the heads 3*b* of the monofilaments 3 when the user wears a wig 21, and is difficult to come off. Furthermore, it is preferable to project the heads 3*b* of the monofilaments 3 since the first half area 1*a* and the second half area 1*b* bonded together two-folded can be easily separated from each other if the wig 21 attached to the user's head is to be detached from the user's head. As a more preferable modification, if one side of each of the stalks 3*a* or the heads 3*b* of the monofilaments 3 is formed into an irregular shape, a locking force generated by the irregular shapes acts on the user's natural hair 20, thereby obtaining a stronger fixing force.

The first adhesive layers 4*a*, 4*b* are bonded onto the heads 3*b* of the monofilaments 3 by coating or the like. One first adhesive layer 4*a* is arranged on the first half area 1*a* except for the first opening 8 and outside of both side ends of the first opening 8. The other first adhesive layer 4*b* is arranged in the rectangular form surrounding the second opening 9. The first adhesive layers 4*a*, 4*b* are covered up on the release sheets 7*a* and 7*b*, respectively, and non-adhesive layer portions 10*a* in which no adhesive layers and no release sheets are provided remain outside of both side ends of the first opening 8 and the first adhesive layer 4*b*, respectively.

These non-adhesive layer portions 10*a* are provided to facilitate operation for detaching the apparatus 1 from the user's head. If the user's natural hair is pulled out onto the apparatus 1 is folded double, the first adhesive layers 4*a*, 4*b* overlap each other. However, only the first adhesive layer 4*a* is present on the non-adhesive layer portions 10*a*. Due to this, if the non-adhesive layer portions 10*a* are pulled out in a release direction when detaching the apparatus 1, the apparatus 1 can be easily released also because of a roughened surface state made by the monofilaments 3 provided on the first side of the apparatus 1.

The net member 5 is arranged on the entire second side of the flexible plane sheet 2 except for the first opening 8 and the second opening 9. The second side of the flexible plane sheet 2 corresponds to a part that is in contact with the user's head when the wig 21 is fixed to the user's head. The net member 5 is employed to lessen an uncomfortable feel caused by the direct contact of the flexible plane sheet 2 with the user's head, to absorb sebum and sweat of the user's head, and to provide a comfortable feel of wearing the wig 21. Further, the apparatus 1 according to the embodiment is configured so that the flexible plane sheet 2 is folded double after user's natural hair 20 is pulled out onto the flexible plane sheet 2 to fixedly hold the natural hair 20. Due to this, it is necessary to keep a state of folding the flexible plane sheet 2 double for a certain period. To keep this state, it is preferable to fixedly attach another material to the flexible plane sheet 2 rather than to solely provide the flexible plane sheet 2. That is why the net member 5 that can give the user the comfortable feel is fixedly arranged on the entire second side of the flexible plane sheet 2.

The second adhesive layer 6 is arranged on the first half area 1*a* except for the first opening 8 and outside of the both side ends of the hole 8 similarly to the first adhesive layer 4*a*, and an outside of the second adhesive layer 6 is covered with the release sheet 7*c*.

(Dimensional and Performance Conditions)

Preferable dimensional and performance conditions of the apparatus 1 as stated above will be described. Preferably, a male sheet (sheet having convex portions) of a surface fastener is used as the flexible plane sheet 2 serving as a base of the monofilaments 3, and a size of the sheet 2 is equal to or larger than 20 millimeters (mm) and equal to or smaller than 30 mm in both height and width. If the size of the flexible plane sheet 2 is smaller than 20 mm, the number of user's natural hairs 20 which one apparatus 1 fixedly holds decreases. To ensure a certain fixing force, it is necessary to attach many apparatus 1, thus making an operation for causing the user to wear or take off the wig 21 complicated. On the other hand, if the size of the flexible plane sheet 2 is larger than 30 mm, the number of user's natural hairs 20 fixedly held by one apparatus 1 becomes excessive. As a result, the user's head is heavily strained and it is difficult to fix the user's natural hairs 20 with a uniform holding force because of overlap of the natural hairs 20.

Furthermore, a thickness of the flexible plane sheet 2 is preferably equal to or larger than 0.1 mm and equal to or smaller than 0.2 mm. If the thickness of the flexible plane sheet 2 is smaller than 0.1 mm, then the flexible plane sheet 2 becomes irregular due to the thickness of the natural hair 20 when the natural hair 20 is held, a force of fixing the wig 21 to the apparatus 1 is weakened, and the user feels uncomfortable with the surface side in contact with the user's head, resulting in insufficient feel of wearing the wig 21. If the thickness of the flexible plane sheet 2 exceeds 0.2 mm, then the apparatus 1 becomes thick per se, and the wig 21 turns in a floating state from the user's head while the user wears the wig 21, resulting in unnatural appearance. Besides, even if the user's natural hair 20 is pressed after being pulled out onto the apparatus 1, the hair 20 is pressurized only insufficiently. As a result, the user's natural hair 20 is not caught up into gaps 4 and 5 between the monofilaments 3 of the flexible planner sheet 2, the anchoring effect is eliminated, and the fixing force is reduced.

As shown in FIGS. 14 and 15, a size of each monofilament 3 is preferably set such that a diameter d1 and a height h1 of the stalk 3*a* and diameters d2 and d3 of the head 3*b* are all equal to or larger than 0.2 mm and equal to or smaller than 0.4 mm. Generally, an average thickness of the user's natural hair 20 is between 0.07 mm and 0.08 mm. If the size of the monofilament 3 is smaller than 0.2 mm, then the number of user's natural hairs 20 that can be fixedly held decreases, a surface area of the monofilaments 3 decreases, the locking force of the monofilaments 3 is weakened, and the fixing force of the apparatus 1 is reduced. If the size of the monofilament 3 exceeds 0.4 mm, then the number of user's natural hairs 20 that can be fixedly held excessively increases, the surface area of the monofilaments 3 is excessively widened, the locking force of the monofilaments 3 per user's natural hair 20 is dispersed, and the stable fixing force cannot be obtained.

Lengthwise and crosswise gaps c1 and c2 between the heads 3*b* of the monofilaments 3 are equal to or larger than 0.1 mm and equal to or smaller than 0.3 mm, and lengthwise and crosswise gaps c3 and c4 between the stalks 3*a* thereof are equal to or larger than 0.2 mm and equal to or smaller than 0.4 mm. Naturally, the gaps c1 and c2 between the heads 3*b* are set narrower than the gaps c3 and c4 between the stalks 3*a*.

By so forming and arranging the monofilaments 3, if the user's natural hair 20 is pulled out onto the apparatus 1 and pressed, the hair 20 caught up into the gaps c3 and c4 between the stalks 3*a* does not come off from between the stalks 3*a* and movement of the hair 20 is restricted. Moreover, even if the number of user's natural hairs 20 that can be caught up into the gaps c3 and c4 between the stalks 3*a* is only two or three, the locking force of locking the hair 20 is uniformly dispersed within the apparatus 1, thereby ensuring the stable fixing force. If the gaps c1 and c2 between the heads 3*b* of the monofilaments 3 are set to be narrower than 0.1 mm, then the user's natural hair 20 cannot enter between the monofilaments 3 but remain on the monofilaments 3. As a result, a strong locking force is not generated and the fixing force is reduced. If the gaps c1 and c2 exceed 0.3 mm, then the user's natural hair 20 entering between the monofilaments 3 tends to project onto the monofilaments 3 again, and the hair 20 is not caught up in the monofilaments 3. As a result, no anchoring effect is produced and the fixing force of fixing the hairs 20 is reduced.

Furthermore, if the lengthwise and crosswise gaps c3 and c4 between the stalks 3*a* of the monofilaments 3 are narrower than 0.2 mm, then the number of user's natural hairs 20 that can enter between the monofilaments 3 decreases, the force of fixing the hair 20 by the monofilaments 3 is reduced and the fixing force of fixing the hair 20 as that of the overall apparatus 1 is reduced. If the gaps c3 and c4 exceed 0.4 mm and the gaps c1 and c2 between the heads 3*b* are equal to or wider than the gaps c3 and c4 between the stalks 3*a*, then the number of user's natural hairs 20 entering between the monofilaments 3 increases, and the hair 20 is offset within the apparatus 1. Besides, the user's natural hair 20 entering between the monofilaments 3 is easily projected by the movement of the user's head to increase the degree of freedom of the hair 20. As a result, the locking force does not effectively act on the hair 20 and the fixing force is reduced.

(Manufacturing Procedures)

Specific manufacturing procedures for the apparatus 1 under the dimensional and performance conditions stated above will be described with reference to FIG. 1. Referring to FIG. 1, a rectangle having a length E of 20 mm to 30 mm and a width F of 20 mm to 30 mm is cut out from a male sheet of a surface fastener, and corners of the rectangle are chamfered into circular arch shapes as an integral material of the flexible plane sheet 2 and the monofilaments 3 satisfying the above-stated conditions.

At a first stage, a rectangular first opening 8 having a length L of 10 mm to 15 mm and having a width I of 1 mm to 5 mm is provided so as to start at a position of 45% of an entire length from an end of the cut rectangle in a direction of the width F and to be parallel to a direction of the length E thereof. The reason for setting the position of the first opening 8 to the position of 45% of the entire length from the end of the rectangle in the width F direction is as follows. The male sheet is bent in the length E direction and folded double starting from the first opening 8 so that the corners of the male sheet completely coincide while the first opening 8 is located at the center. If the corners are overlapped to be offset, the user's natural hair 20 is entangled with the monofilaments 3 and the adhesive layer parts in portions forced out from the overlapped portions.

At a second stage, an oblong second opening 9 is provided in a central portion of the second half area 1*b* away from the first opening 8 at a predetermined distance so as to be parallel to the first opening 8. A length M by a width H of this second opening 9 is set smaller than that of the first opening 8. As stated in the "MEANS TO SOLVE PROBLEMS", the second opening 9 plays a role of preventing the wig 21 from floating and being turned up. Since it suffices that an amount of the user's natural hair 20 pulled out from the second opening 9 is smaller than that pulled out from the first opening 8, a size of the second opening 9 is set smaller than that of the first opening 8. Furthermore, by providing the second opening 9 in parallel to the first opening 8, the highest effect of preventing the wig 21 from floating is produced and the wig 21 can easily follow the movement of the user's head. Due to this, even if the user's natural hair 20 is pulled, the resulting pain can be eased.

At a third stage, the first adhesive layers 4*a*, 4*b* are formed on the monofilaments 3. One first adhesive layer 4*a* is provided from one side edge of the first half area 1*a* of the apparatus 1 to one side edge of the first opening 8. The other first adhesive layer 4*b* is provided within a predetermined range surrounding the second opening 9 rectangularly on the second half area 1*b* of the apparatus 1. The release sheets 7*a* and 7*b* are bonded onto the first adhesive layers 4*a*, 4*b*, respectively, and the non-adhesive layer portions 10*a* in which no adhesive layers and no release sheets are provided remain outside of the both side ends of the first opening 8 and the first adhesive layer 4*b*, respectively.

A component of the first adhesive layers 4*a*, 4*b* is preferably a natural or synthetic rubber-based component since it is soft and elastic so that it can easily follow the movement of the user's head. The synthetic rubber is particularly preferable because of its small temporal change and stable physical property. A thickness of the first adhesive layers 4*a*, 4*b* is preferably equal to or larger than 0.05 mm and equal to or smaller than 0.2 mm. If the thickness of the first adhesive layers 4*a*, 4*b* is smaller than 0.05 mm, a sufficient fixing force of fixing the user's natural hair 20 cannot be ensured. If the thickness of the first adhesive layers 4*a*, 4*b* exceeds 0.2 mm, then the entire apparatus 1 becomes thick, and the wig 21 is in a floating state when the user wears the wig 21, resulting in the unnatural appearance. Besides, the user's natural hair 20 cannot enter between the monofilaments 3 when the hair 20 is held by the apparatus 1, and the locking effect of locking the hair 20 by the monofilaments 3 cannot be produced. As a result, the sufficient anchoring effect cannot be obtained and the fixing force is reduced.

Moreover, an adhesive force of the first adhesive layers 4*a*, 4*b* is preferably equal to or larger than 1.5 kg/cm and equal to or smaller than 3.0 kg/cm. If the adhesive force of the first adhesive layers 4*a*, 4*b* is smaller than 1.5 kg/cm, the sufficient fixing force cannot be obtained. Due to this, even if the apparatus 1 is bent, the apparatus 1 may possibly be opened. If the adhesive force of the first adhesive layers 4*a*, 4*b* exceeds 3.0 kg/cm, it is difficult to open the apparatus 1 bent when the user takes off the wig 21. As a result, there occur such problems as inability to return the user's natural hair 20 pulled out onto the apparatus 1 to original positions and a laborious operation for removing the first adhesive layers 4*a*, 4*b* adhering to the user's natural hair 20.

At a fourth stage, the net member 5 is fixedly attached to the entire second side of the flexible plane sheet 2. As the net member 5, an apparatus having a thread diameter equal to or larger than 0.03 mm and equal to or smaller than 0.08 mm with the number of meshes being equal to or larger than 100 and equal to or smaller than 150 is preferably used. If the thread diameter is smaller than 0.03 mm, the user is given the same feel as that if the flexible plane sheet 2 directly contacts with the scalp, so that the uncomfortable feel of wearing the wig 21 cannot be lessened. If the thread diameter exceeds 0.08 mm, then the net member 5 becomes thick per se, the apparatus 1 becomes bulky, and the wig 21 floats when the user wears the wig 21, resulting in the unnatural appearance. Further, if the number of meshes is smaller than 100, then sizes of the messes of the net member 5 is made large, the height distance between the monofilaments 3 constituting the net member 5 and the meshes increases, and the user feels uncomfortable with wearing the wig 21. Besides, the holding force during the folding of the apparatus is the same as that in the case where the net member 5 is not fixedly attached to the entire second side of the flexible plane sheet 2. If the number of meshes exceeds 150, the size of the meshes is too small. As a result, the net member 5 does not absorb the sebum and sweat of the scalp while the user wears the wig 21 to make the user feel uncomfortable, the apparatus 1 is difficult to fold, and the holding force of holding the bent state is reduced.

At a fifth stage, the second adhesive layer 6 is provided on the net member 5 fixedly attached only to the second side of the first half area 1*a* of the apparatus 1 serving as a portion fixing the wig 21 at the fourth stage, and the release sheet 7*c* is bonded onto the second adhesive layer 6.

(Fixing Method)

A fixing method of the apparatus 1 according to the embodiment of the present invention will be described with reference to FIGS. 4 to 13 while appropriately referring to FIGS. 1 to 3, 14, and 15. FIG. 10 is a rear view of an ordinary wig 21. A circumferential edge 22 of the wig 21 is constituted by a thermoplastic resin sheet, and artificial hair 25 is transplanted entirely on a wig base 24 an interior of which is formed integrally by a net 23. A plurality of apparatus 1 is fixed onto an inner circumference of the circumferential edge 22 at predetermined intervals. The configuration of the wig 21 is not limited to that shown in FIG. 10. The present invention is applicable to any configuration of the wig 21 such as a configuration in which the entire wig base 24 is made of thermoplastic resin or so-called artificial skin or constituted only by a net.

Figure 4:
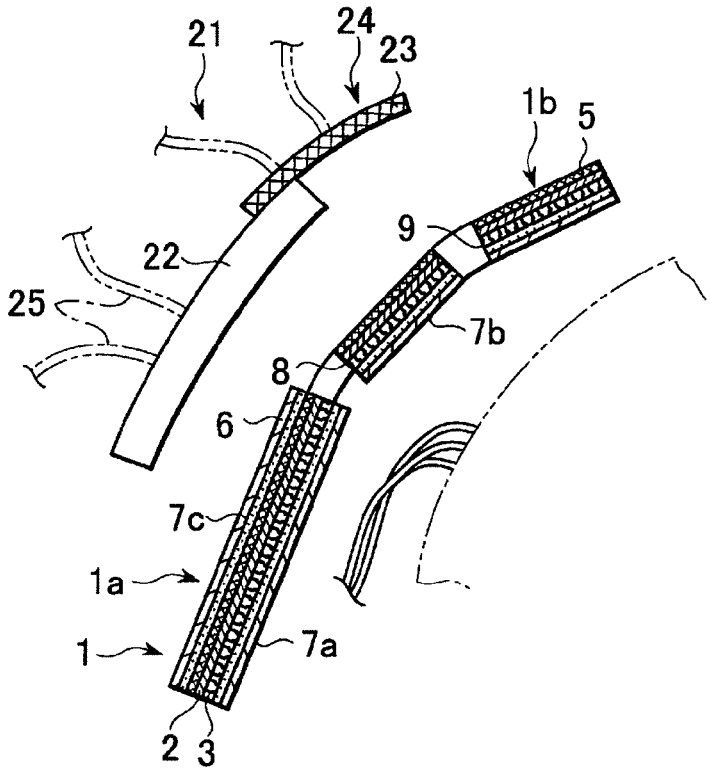
FIG. 4 is an explanatory view of procedures of attaching a wig to the user's head using the apparatus shown in the embodiment of the present invention.
Figure 5:
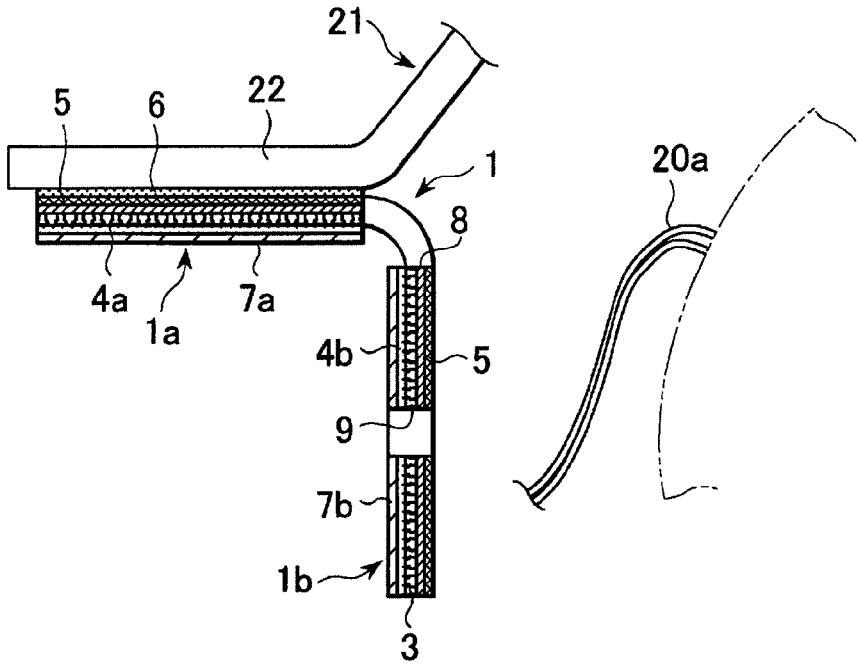
FIG. 5 is an explanatory view of procedures of attaching the wig to the user's head using the apparatus shown in the embodiment of the present invention.

First, as shown in FIG. 4, the apparatus 1 is arranged so as to face the second side of the apparatus 1 to the circumferential edge 22 of the wig 21, and to face the second half area 1*b* to the inner circumference of the wig 21. As shown in FIG. 5, the release sheet 7*c* covering up the second adhesive layer 6 is released and the second adhesive layer 6 is bonded onto a predetermined position on the inner side of the circumferential edge 22 of the wig base 24, thereby fixedly attaching a plurality of apparatus 1 to the wig 21 at equidistant intervals. In this state, only the first half area 1*a* of each of the apparatus 1 is fixed to the circumferential edge 22 whereas the second half area 1*b* thereof is free relative to the wig 21.

Figure 6:
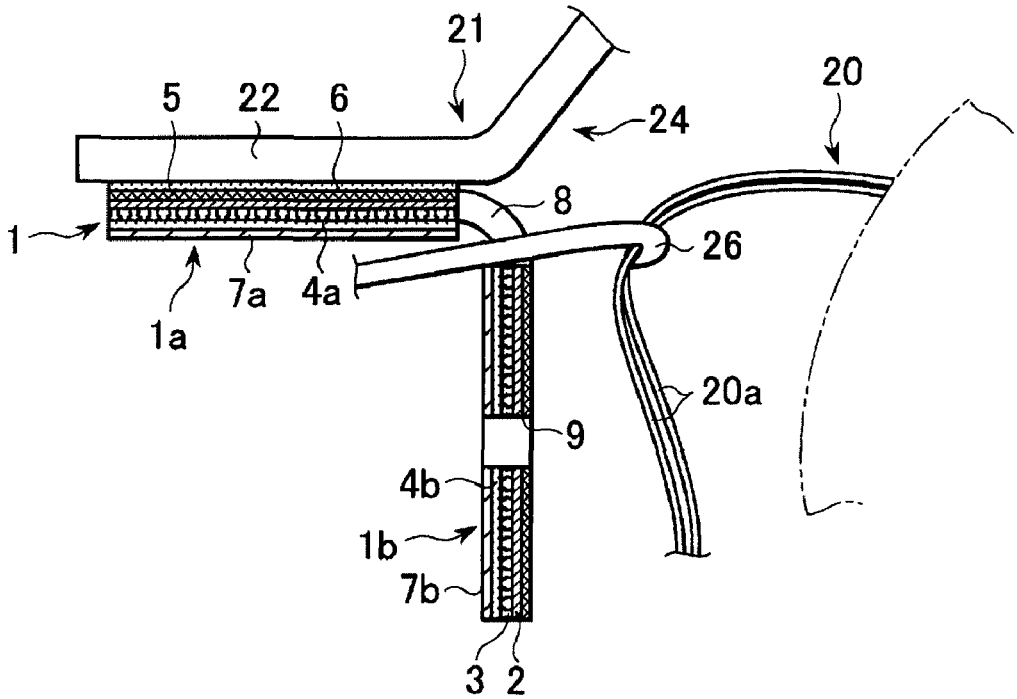
FIG. 6 is an explanatory view of procedures of attaching the wig to the user's head using the apparatus shown in the embodiment of the present invention.
Figure 7:
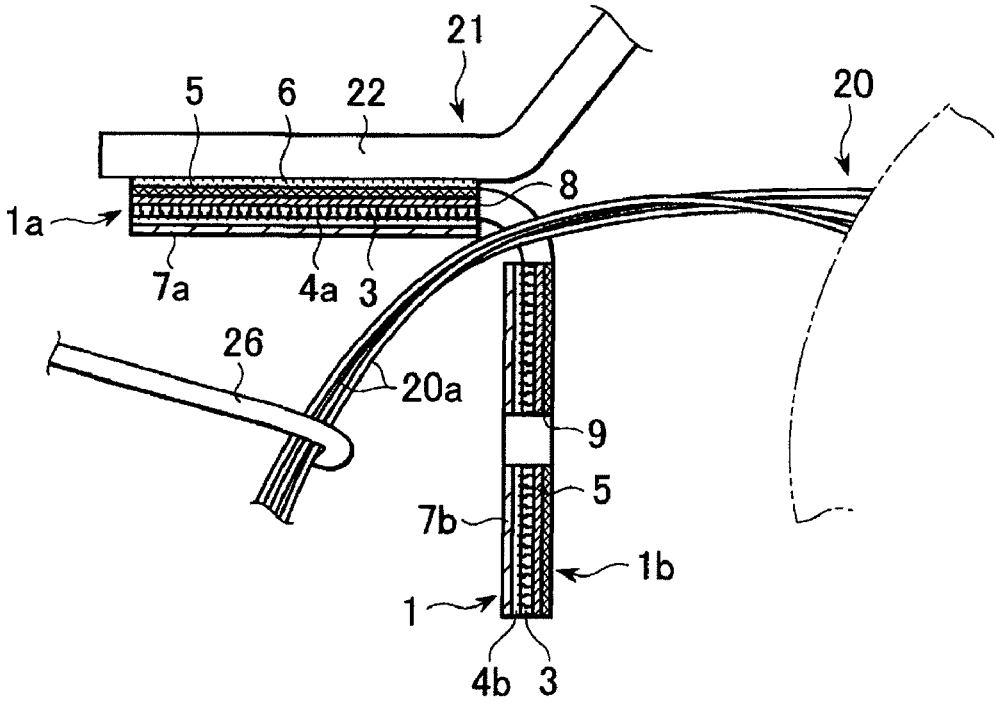
FIG. 7 is an explanatory view of procedures of attaching the wig to the user's head using the apparatus shown in the embodiment of the present invention.
Figure 8:
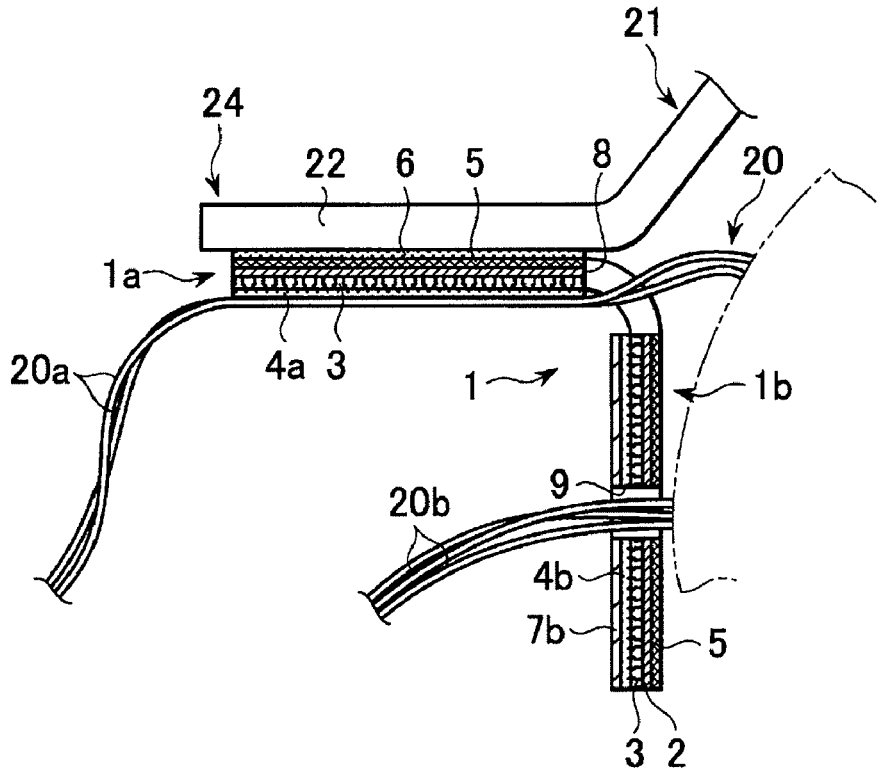
FIG. 8 is an explanatory view of procedures of attaching the wig to the user's head using the apparatus shown in the embodiment of the present invention.

As shown in FIG. 6, after putting the wig 21 on the user's head at a predetermined position, a tappet 26 passes through the first opening 8 from the first side of the flexible plane sheet 2 of the apparatus 1 (from the monofilaments 3 side). A part 20*a* of the user's natural hair 20 right under the first opening 8 is caught up in a tip end of the tappet 26 on the second side of the flexible plane sheet 2 of the apparatus 1 (on net member 5 side). As shown in FIG. 7, by pulling back the tappet 26, a part 20*a* of the user's natural hair 20 is pulled out from the first opening 8 toward the first side of the flexible plane sheet 2. The number of a part 20*a* of the user's natural hairs 20 pulled out from the first opening 8 is preferably equal to or larger than 2 and equal to or smaller than 30 according to a hair remaining state of the user. If more hairs 20 are pulled out, a portion of the wig 21 from which the hair 20*a* is pulled out becomes thick to make the wig 21 irregular, with the result that the user feels uncomfortable with the user's head. Further, the holding and fixing force per hair 20 is dispersed, so that the user cannot stably wear the wig 21. As shown in FIG. 8, a part 20*a* of the user's natural hair 20 pulled out from the first opening 8 is adhesively bonded onto the first adhesive layer 4*a* from which the release sheet 7*a* on the first half area 1*a* is released so as not to loosen.

Likewise, as shown in FIG. 8, the tappet 26 passes through the second opening 9 of the apparatus 1 from the first side of the flexible plane sheet 2 (from monofilaments 3 side). The other part 20*b* of the user's natural hair 20 is caught up in the tip end of the tappet 26 on the second side of the flexible plane sheet 2 (on net member 5 side), and the tappet 26 is pulled back, thereby pulling out the other part 20*b* of the user's natural hair 20 from the second opening 9 toward the first side of the flexible plane sheet 2. With a view of preventing the circumferential edge 22 of the wig 21 from floating or being turned up, the number of the other part 20*b* of the user's natural hairs 20 pulled out from the second opening 9 is preferably equal to or larger than 1 and equal to or smaller than 15 that is smaller than the number of a part 20*a* of the user's natural hairs 20 according to the hair remaining state of the user. The other part 20*b* of the user's natural hair 20 pulled out from the second opening 9 is adhesively bonded onto the first adhesive layer 4*b* from which the release sheet 7*b* is released on the second half area 1*b* so as not to loosen.

Figure 9:
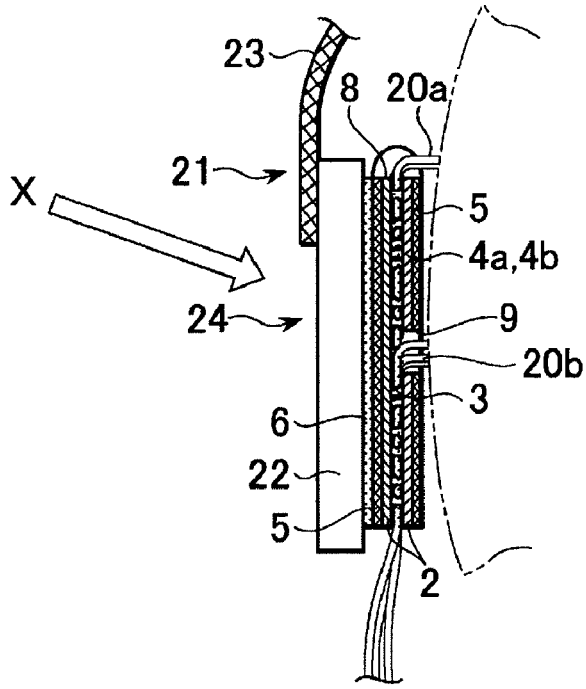
FIG. 9 is an explanatory view of procedures of attaching the wig to the user's head using the apparatus shown in the embodiment of the present invention.
Figure 10:
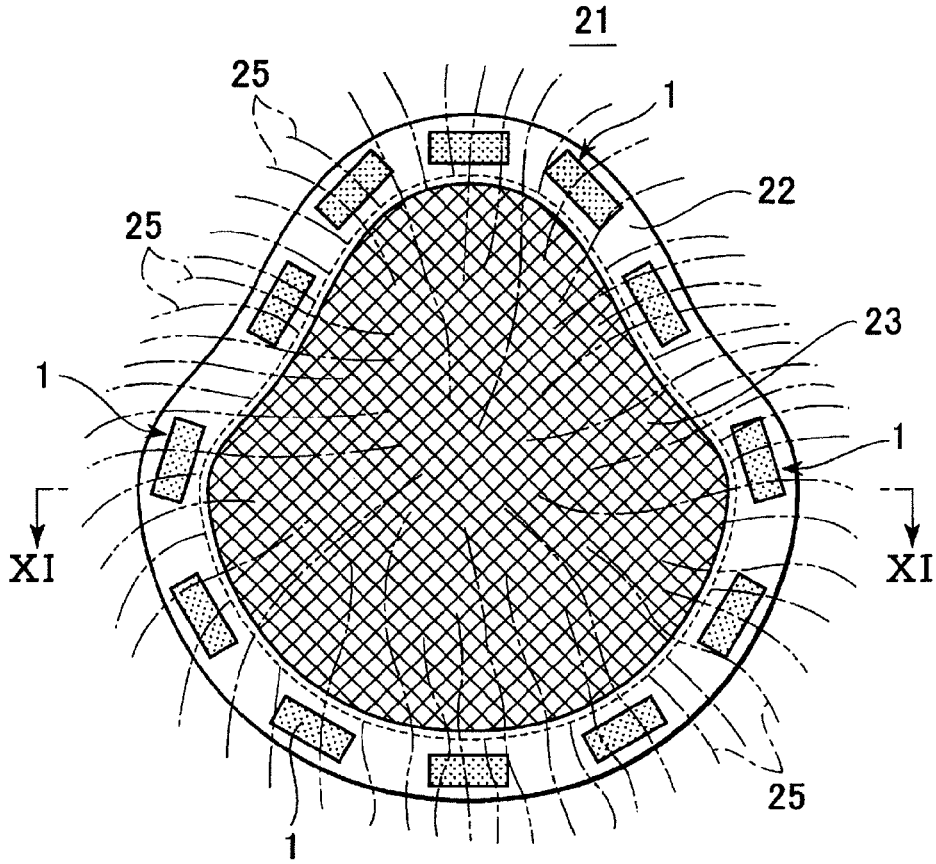
FIG. 10 is a diagram showing a state in which the apparatus according to the embodiment of the present invention is attached to a rear surface of the wig.
Figure 11:
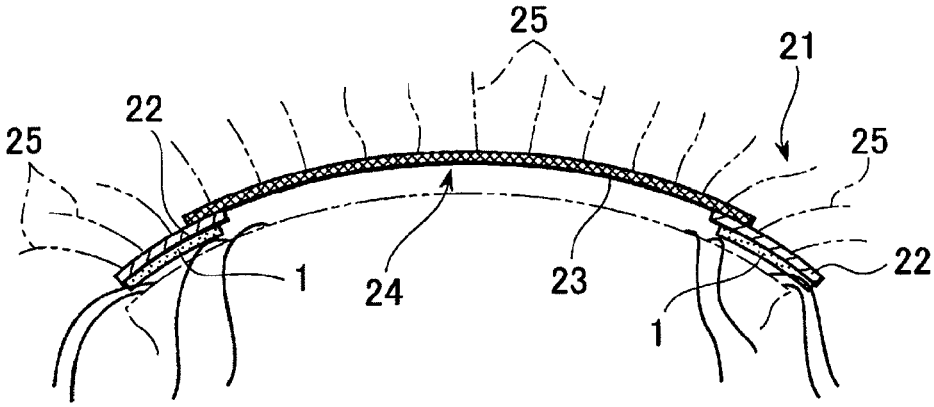
FIG. 11 is a cross-sectional view taken along a line XI-XI of FIG. 10 showing the state in which the apparatus according to the embodiment of the present invention is attached to the rear surface of the wig.

As shown in FIG. 9, the first half area 1*a* is bent toward the second half area 1*b* at the centerline CL bisecting the apparatus 1 and the first half area 1*a* is overlapped with the second half area 1*b* while holding the parts 20*a* and 20*b* of the user's natural hair 20 pulled out from the first opening 8 and the second opening 9, respectively, between the first half area 1*a* and the second half area 1*b* of the apparatus 1. A slight pressurizing force is applied onto the apparatus 1 from an arrow X direction, whereby the monofilaments 3 on the first half area 1*a*, the monofilaments 3 on the second half area 1*b*, and the parts 20*a* and 20*b* of the user's natural hair 20 are entangled with and caught up in one another and attached to one another in an engageable fashion. Further, the first adhesive layers 4*a*, 4*b* are entangled with the monofilaments 3 and the parts 20*a* and 20*b* of the user's hair 20 attached to one another in the engageable fashion, and the adhesive force of the adhesive layers 4*a*, 4*b* is additionally applied to the engageable attachment of the monofilaments 3 and the parts 20*a* and 20*b* of the user's hair 20, thereby fixing the wig 21 to the user's head. As can be seen, the apparatus 1 is folded double to overlap the first half area 1*a* with the second half area 1*b* of the apparatus 1. Due to this, an area of the apparatus 1 folded double is about the half of that before the apparatus 1 is folded double. Besides, in this state, the first opening 8 is located at a position at which the apparatus 1 is bent.

FIGS. 12 and 13 are detailed views of the first adhesive layers 4*a*, 4*b*, the monofilaments 3, the parts 20*a* and 20*b* of the user's natural hair 20 if the apparatus 1 is folded double. Many monofilaments 3 provided on the first half area 1*a* and the second half area 1*b* face each other and are inserted deep into each other while breaking through the first adhesive layers 4*a*, 4*b* overlapping each other on the monofilaments 3. The monofilaments 3 are entangled with the parts 20*a* and 20*b* of the user's natural hair 20 pulled out from the first opening 8 and the second opening 9 toward between the first half area 1*a* and the second half area 1*b* while holding the parts 20*a* and 20*b* between the monofilaments 3. Further, the heads 3*b* of the monofilaments 3 are caught up in the stalks 3*a* and heads 3*b* of the other monofilaments 3 and the parts 20*a* and 20*b* of the user's natural hair 20. As a result, the anchoring effect of making it difficult to pull out the parts 20*a* and 20*b* is produced, thereby keeping a tangling state. Moreover, the first adhesive layers 4*a*, 4*b* enter between the monofilaments 3 and the parts 20*a* and 20*b* of the user's natural hair 20 thus caught up one another. The adhesive force of the first adhesive layers 4*a*, 4*b* produces a synergic effect of increasing the states in which they are entangled and caught in one another. Thus, an overlapping state of the first half area 1*a* and the second half area 1*b* is maintained, that is, the parts 20*a* and 20*b* of the user's natural hair 20 pulled out between the both half areas 1*a* and 1*b* are firmly held.

Moreover, if the wig 21 fixed to the user's head using the apparatus 1 is to be detached from the user's head, portions of the circumferential edge 22 of the wig 21 in which portions the respective apparatus 1 are attached to the apparatus 1 are rolled up. Further, portions of each apparatus 1 onto which the first adhesive layer 4*b* is not applied, that is, at least one of the non-adhesive layer portions 10*a* on the second half area 1*b* and a portion on the first half area 1*a* opposed to the portion on the second half area 1*b* are pulled in opposite directions to widen the bent apparatus 1. The parts 20*a* and 20*b* of the user's natural hair 20 pulled out onto the apparatus 1 are pulled up from the first opening 8 and the second opening 9, thereby detaching the wig 21 from the user's head. Thereafter, the apparatus 1 bonded onto the circumferential edge 22 of the wig 21 are detached.

EXAMPLES

The apparatus 1 according to three Examples and eleven Comparative examples were produced and experiments of fixing the wig 21 to the user's head using each of the produced apparatus 1 were conducted, respectively. A method of each experiment is based on a qualitative evaluation of observing a temporal change while causing a subject to actually wear the wig 21, and on a quantitative evaluation of measuring a strength (load) using a measuring tool.

Example 1

The following conditions are set for the apparatus 1 employed in Example 1.

- Size of the flexible plane sheet 2: 25 mm in the length E, 20 mm in the width F, and 9 mm in the length G to the first opening 8 on the first half area 1*a* side
- Thickness of the flexible plane sheet 2: 0.15 mm
- Size of each monofilament 3: 0.25 mm in the diameter d1 of the stalk 3*a*, 0.40 mm in the height h1 of the stalk 3*a*, 0.40 mm in the diameter d2 of the head 3*b*, and 0.30 mm in the diameter d3 of the head 3*b*
- Interval between the heads 3*b* of the monofilaments 3: 0.30 mm in the interval c1 between the heads 3*b* and 0.15 mm in the interval c2 between the heads 3*b*
- Interval between the stalks 3*a* of the monofilaments 3: 0.40 mm in the interval c3 between the stalks 3*a* and 0.20 mm in the interval c4 between the stalks 3*a*
- Thickness of the first adhesive layers 4*a*, 4*b*: 0.10 mm.
- Adhesive force of the first adhesive layers 4*a*, 4*b*: 2.23 kg/cm.
- Thread diameter of the net member 5: 0.05 mm.
- Number of meshes of the net member 5: 124 meshes/inch The following items other than the above-stated conditions are set to be common to Examples 1 to 3 and Comparative examples 1 to 9.

- First opening 8: 19 mm in the length L and 2 mm in the width I
- Second opening 9: 10 mm in the length M and 1 mm in the width H
- Distance J between the first opening 8 and the second opening 9: 4 mm
- Width K of the non-adhesive layer portion 10*a*: 5 mm

Example 2

The apparatus 1 employed in Example 2 is the same as that in Example 1 except that the following conditions were set smaller than those in Example 1.

- Size of the flexible plane sheet 2: 20 mm in the length E
- Thickness of the flexible plane sheet 2: 0.11 mm
- Size of each monofilament 3: 0.20 mm in the diameter d1 of the stalk 3*a*, 0.21 mm in the height h1 of the stalk 3*a*, 0.22 mm in the diameter d2 of the head 3*b*, and 0.20 mm in the diameter d3 of the head 3*b*
- Interval between the heads of the monofilaments 3: 0.11 mm in the interval c1 between the heads 3*b* and 0.10 mm in the interval c2 between the heads 3*b*
- Interval between the stalks of the monofilaments 3: 0.22 mm in the interval c3 between the stalks 3*a*
- Thickness of the first adhesive layers 4*a*, 4*b*: 0.05 mm
- Adhesive force of the first adhesive layers 4*a*, 4*b*: 1.53 Kg/cm
- Thread diameter of the net member 5: 0.03 mm
- Number of meshes of the net member 5: 100 meshes/inch

Example 3

The apparatus 1 employed in Example 3 is the same as that in Example 1 except that the following conditions were set larger than those in Example 1. It should be noted that only the height 1 of the stalk 3*a* is set smaller that that in Example 1 in view of the other conditions.

- Size of the flexible plane sheet 2: 30 mm in the length E and 28 mm in the width F
- Thickness of the flexible plane sheet 2: 0.20 mm
- Size of each monofilament 3: 0.40 mm in the diameter d1 of the stalk 3*a*, 0.38 mm in the height h1 of the stalk 3*a*, and 0.40 mm in the diameter d3 of the head 3*b*
- Interval between the heads 3*b* of the monofilaments 3: 0.30 mm in the interval c2 between the heads 3*b*
- Interval between the stalks of the monofilaments 3: 0.40 mm in the interval c4 between the stalks 3*a*
- Thickness of the first adhesive layers 4*a*, 4*b*: 0.20 mm
- Adhesive force of the first adhesive layers 4*a*, 4*b*: 3.00 kg/cm
- Thread diameter of the net member 5: 0.08 mm
- Number of meshes of the net member 5: 150 meshes/inch

Comparative Examples 1 to 11

As apparatus 1 employed in the respective Comparative examples, the apparatus 1 in Comparative example 1 for comparing presence and absence of the monofilaments 3 with respect to Example 1, the apparatus 1 in Comparative examples 2 and 3 for comparing the size of each monofilament 3 with that according to Example 1, the apparatus 1 in Comparative examples 4 and 5 for comparing the gaps c1 and c2 between the heads 3*b* of the monofilaments 3 with those according to Example 1, the apparatus 1 in Comparative examples 6 and 7 for comparing the gaps c3 and c4 between the stalks 3*a* of the monofilaments 3 with that according to Example 1, the apparatus 1 in Comparative examples 8 and 9 for comparing the thickness of the first adhesive layers 4*a*, 4*b* with that according to Example 1, and the apparatus 1 in Comparative examples 10 and 11 for comparing the adhesive force of the first adhesive layers 4*a*, 4*b* with that according to Example 1 were produced. The following conditions were set for the apparatus 1 in Comparative examples 1 to 9, respectively.

- Comparative example 1: the same as Example 1 except that no monofilaments 3 were provided to make the first side flat.
- Comparative example 2: the same as Example 1 except that the diameter d1 of the stalk 3*a* is 0.10 mm, the height h1 of the stalk 3*a* is 0.10 mm, the diameter d2 of the head 3*b* is 0.10 mm, and the diameter d3 of the head 3*b* is 0.10 mm as the size of each monofilament 3.

Comparative example 3: the same as Example 1 except that the diameter d1 of the stalk 3*a* is 0.40 mm, the height h1 of the stalk 3*a* is 0.45 mm, the diameter d2 of the head 3*b* is 0.55 mm, and the diameter d3 of the head 3*b* is 0.45 mm as the size of each monofilament 3.

Comparative example 4: the same as Example 1 except that the gap c1 between the heads 3*b* of the monofilaments 3 is 0.05 mm and the gap c2 between the heads 3*b* thereof is 0.05 mm.

Comparative example 5: the same as Example 1 except that the gap c1 between the heads 3*b* of the monofilaments 3 is 0.40 mm and the gap c2 between the heads 3*b* thereof is 0.40 mm.

Comparative example 6: the same as Example 1 except that the gap c3 between the stalks 3*a* of the monofilaments 3 is 0.10 mm and the gap c4 between the stalks 3*a* thereof is 0.10 mm.

Comparative example 7: the same as Example 1 except that the gap c3 between the stalks 3*a* of the monofilaments 3 is 0.50 mm and the gap c4 between the stalks 3*a* thereof is 0.50 mm.

Comparative example 8: the same as Example 1 except that the thickness of the first adhesive layers 4*a*, 4*b* is 0.03 mm.

Comparative example 9: the same as Example 1 except that the thickness of the first adhesive layers 4*a*, 4*b* is 0.30 mm.

Comparative example 10: the same as Example 1 except that the adhesive force of the first adhesive layers 4*a*, 4*b* is 1.02 kg/cm.

Comparative example 11: the same as Example 1 except that the adhesive force of the first adhesive layers 4*a*, 4*b* is 3.71 kg/cm.

A list of the conditions in Examples 1 to 3 and Comparative examples 1 to 11 is shown in Table 1 below.

TABLE 1

| Items | | Example 1 | Example 2 | Example 3 | Compar. example 1 | Compar. example 2 | Compar. example 3 | Compar. example 4 |
|---|---|---|---|---|---|---|---|---|
| Size of flexible sheet (mm) | length (E) | 25.00 | 20.00 | 30.00 | 1.00 | 25.00 | 25.00 | 25.00 |
| | width (F) | 20.00 | 20.00 | 28.00 | 20.00 | 20.00 | 20.00 | 20.00 |
| Thickness of flexible sheet (mm) | | 0.15 | 0.11 | 0.20 | 0.15 | 0.15 | 0.15 | 0.15 |
| Size of monofilament (mm) | diameter of stalk (d1) | 0.25 | 0.2 | 0.40 | | 0.10 | 0.40 | 0.25 |
| | height of stalk (h1) | 0.40 | 0.21 | 0.38 | | 0.10 | 0.45 | 0.40 |
| | diameter of head (d2) | 0.40 | 0.22 | 0.40 | | 0.10 | 0.55 | 0.40 |
| | diameter of head (d3) | 0.30 | 0.20 | 0.40 | | 0.10 | 0.45 | 0.30 |
| Interval between heads (mm) | (c1) | 0.30 | 0.11 | 0.30 | | 0.30 | 0.30 | 0.05 |
| | (c2) | 0.15 | 0.10 | 0.30 | | 0.15 | 0.15 | 0.05 |
| Interval between stalks (mm) | (c3) | 0.40 | 0.22 | 0.40 | | 0.40 | 0.40 | 0.40 |
| | (c4) | 0.20 | 0.20 | 0.40 | | 0.20 | 0.20 | 0.20 |
| Thickness of first adhesive layer (mm) | | 0.10 | 0.05 | 0.20 | 0.10 | 0.10 | 0.10 | 0.10 |
| Adhesive force of first adhesive layer (kg/mm) | | 2.23 | 1.53 | 3.00 | 2.23 | 2.23 | 2.23 | 2.23 |
| Tread diameter of net member (mm) | | 0.05 | 0.03 | 0.08 | 0.05 | 0.05 | 0.05 | 0.05 |
| Number of mesh of net member (mesh/inch) | | 124 | 100 | 150 | 124 | 124 | 124 | 124 |
| Evaluation | In attaching | ○ | ○ | ○ | X | Δ | Δ | Δ |
| | In detaching | ○ | ○ | ○ | X | X | ○ | ○ |

| Items | | Compar. example 5 | Compar. example 6 | Compar. example 7 | Compar. example 8 | Compar. example 9 | Compar. example 10 | Compar. example 11 |
|---|---|---|---|---|---|---|---|---|
| Size of flexible sheet (mm) | length (E) | 25.00 | 25.00 | 25.00 | 25.00 | 25.00 | 25.00 | 25.00 |
| | width (F) | 20.00 | 20.00 | 20.00 | 20.00 | 20.00 | 20.00 | 20.00 |
| Thickness of flexible sheet (mm) | | 0.15 | 0.15 | 0.15 | 0.15 | 0.15 | 0.15 | 0.15 |
| Size of monofilament (mm) | diameter of stalk (d1) | 0.25 | 0.25 | 0.25 | 0.25 | 0.25 | 0.25 | 0.25 |
| | height of stalk (h1) | 0.40 | 0.40 | 0.40 | 0.40 | 0.40 | 0.40 | 0.40 |
| | diameter of head (d2) | 0.40 | 0.40 | 0.40 | 0.40 | 0.40 | 0.40 | 0.40 |
| | diameter of head (d3) | 0.30 | 0.30 | 0.30 | 0.30 | 0.30 | 0.30 | 0.30 |
| Interval between heads (mm) | (c1) | 0.40 | 0.30 | 0.30 | 0.30 | 0.30 | 0.30 | 0.30 |
| | (c2) | 0.40 | 0.15 | 0.15 | 0.15 | 0.15 | 0.15 | 0.15 |
| Interval between stalks (mm) | (c3) | 0.40 | 0.10 | 0.50 | 0.40 | 0.40 | 0.40 | 0.40 |
| | (c4) | 0.20 | 0.10 | 0.50 | 0.20 | 0.20 | 0.20 | 0.20 |
| Thickness of first adhesive layer (mm) | | 0.10 | 0.10 | 0.10 | 0.03 | 0.30 | 0.10 | 0.10 |
| Adhesive force of first adhesive layer (kg/mm) | | 2.23 | 2.23 | 2.23 | 2.23 | 2.23 | 1.02 | 3.71 |
| Tread diameter of net member (mm) | | 0.05 | 0.05 | 0.05 | 0.05 | 0.05 | 0.05 | 0.05 |
| Number of mesh of net member (mesh/inch) | | 124 | 124 | 124 | 124 | 124 | 124 | 124 |
| Evaluation | In attaching | X | X | Δ | X | Δ | X | ○ |
| | In detaching | X | ○ | ○ | ○ | X | — | X |

NOTE:
○ Good,
Δ Poor,
X Bad (Results of Experiments)

As for the qualitative evaluation, the wig 21 was fixed to the user's head using the apparatus 1 and a temporal change was observed. As a result, in each of Examples 1 to 3, even on the 30th day since the user wore the wig 21, the portions in which the user's natural hair 20 was fixed did not loosen and the fixing force hardly changed from that while the user wore the wig 21 although floating or instability due to natural growth of the user's natural hair 20 was unavoidable.

As for detachment of the wig 21, the first half area 1*a* and the second half area 1*b* of each apparatus 1 were pulled in opposite directions to widen the bent apparatus 1. The user's natural hair 20 held was pulled up from the apparatus 1, whereby the wig 21 could be detached from the user's head. In each of Examples 1 to 3, the apparatus 1 could be easily widened, an amount of adhesion of the first adhesive layers 4*a*, 4*b* to the parts 20*a* and 20*b* of the user's natural hair 20 held by the apparatus 1 was small, and operation was easy and simple.

In Comparative example 1, as compared with Examples 1 to 3, the apparatus 1 did not include monofilaments 3. Due to this, on the twelfth day since the user wore the wig 21, the portions in which the user's natural hair 20 was fixed loosened, the hair 20 came off, and the wearing state became unstable, so that the wig 21 was detached from the user's head. Further, it was difficult to widen the apparatus 1, the apparatus 1 were damaged while widening the apparatus 1, and it took long time to detach the user's natural hair 20 from the apparatus 1 using an organic solvent-based degloss.

In Comparative example 2, since all the monofilaments 3 were too small in size and the user's natural hair 20 did not tangle with the monofilaments 3, the anchoring effect was not produced and the fixing force was weak. The portions in which the user's natural hair 20 was fixed loosened or the hair 20 came off and the wearing state became unstable on the twelfth day since the user wore the wig 21. Due to this, the wig 21 was detached from the user's head. As for detachment of the wig 21, it was difficult to widen the apparatus 1, the apparatus 1 were damaged while widening the apparatus 1, and it took long time to detach the user's natural hair 20 from the apparatus 1 using an organic solvent-based degloss similarly to Comparative example 1. In Comparative example 3, all the monofilaments 3 were large in size and the height of the stalk 3*a* of each monofilament 3 was particularly large. The gap between the user's natural hair 20 entering between the monofilaments 3 and each of the monofilaments 20 became wide, and the fixing force was weak. On the tenth day since the user wore the wig 21, the portions in which the user's natural hair 20 was fixed loosened, the hair 20 came off, and the wearing state became unstable, so that the wig 21 was detached from the user's head. As for detachment of the wig 21, similarly to Examples 1 to 3, the apparatus 1 could be easily widened, an amount of adhesion of the first adhesive layers 4*a*, 4*b* to the parts 20*a* and 20*b* of the user's natural hair 20 held by the apparatus 1 was small, and operation was easy and simple.

In Comparative example 4, the gaps c1 and c2 between the heads 3*b* of the monofilaments 3 were too narrow, so that the user's natural hair 20 could not enter between the monofilaments 3. If each apparatus 1 was folded double, the holding force was produced only by the heads 3*b* of the monofilaments 3 arranged on one half area and the other half area and the fixing force was weak. On the twelfth day since the user wore the wig 21, the portions in which the user's natural hair 20 was fixed loosened, the hair 20 came off, and the wearing state became unstable, so that the wig 21 was detached from the user's head. As for detachment of the wig 21, similarly to Examples 1 to 3, the apparatus 1 could be easily widened, an amount of adhesion of the first adhesive layers 4*a*, 4*b* to the parts 20*a* and 20*b* of the user's natural hair 20 held by the apparatus 1 was small, and operation was easy and simple. In Comparative example 5, the gaps between the heads 3*b* of the monofilaments 3 were too wide, so that the user's natural hair 20 entering between the monofilaments tended to be forced out of between the monofilaments according to the movement of the user's head and the stable fixing force could not be produced. On the seventh day since the user wore the wig 21, the portions in which the user's natural hair 20 was fixed loosened, the hair 20 came off, and the wearing state became unstable, so that the wig 21 was detached from the user's head. Further, As for detachment of the wig 21, similarly to Comparative example 1, it was difficult to widen the apparatus 1, the apparatus 1 were damaged while widening the apparatus 1, and it took long time to detach the user's natural hair 20 from the apparatus 1 using an organic solvent-based degloss.

In Comparative example 6, the gaps c1 and c2 between the heads 3*b* of the monofilaments 3 were too narrow. Due to this, the user's natural hair 20 entering between the monofilaments 3 were not held between the stalks 3*a* of the monofilaments 3 and the fixing force was weak. On the ninth day since the user wore the wig 21, the portions in which the user's natural hair 20 was fixed loosened, the hair 20 came off, and the wearing state became unstable, so that the wig 21 was detached from the user's head. As for detachment of the wig 21, similarly to Examples 1 to 3, the apparatus 1 could be easily widened, an amount of adhesion of the first adhesive layers 4*a*, 4*b* to the parts 20*a* and 20*b* of the user's natural hair 20 held by the apparatus 1 was small, and operation was easy and simple. In Comparative example 7, the gaps c3 and c4 between the stalks 3*a* of the monofilaments 3 were too narrow. Due to this, gaps between the user's natural hair 20 entering between the monofilaments 3 and the monofilaments 3 became wide, and the fixing force was weak. On the tenth day since the user wore the wig 21, the portions in which the user's natural hair 20 was fixed loosened, the hair 20 came off, and the wearing state was unstable, so that the wig 21 was detached from the user's head. As for detachment of the wig 21, similarly to Examples 1 to 3, the apparatus 1 could be easily widened, an amount of adhesion of the first adhesive layers 4*a*, 4*b* to the parts 20*a* and 20*b* of the user's natural hair 20 held by the apparatus 1 was small, and operation was easy and simple.

In Comparative example 8, the first adhesive layers 4*a*, 4*b* were thin. Due to this, if the user's natural hair 20 was held by the apparatus 1, then an entire surface of the user's natural hair 20 was not covered with the adhesive layer 4*a* or 4*b*, and the fixing force derived from the adhesive layers 4*a*, 4*b* was reduced. On the eighth day since the user wore the wig 21, the portions in which the user's natural hair 20 was fixed loosened, the hair 20 came off, and the wearing state became unstable, so that the wig 21 was detached from the user's head. As for detachment of the wig 21, similarly to Examples 1 to 3, the apparatus 1 could be easily widened, an amount of adhesion of the first adhesive layers 4*a*, 4*b* to the parts 20*a* and 20*b* of the user's natural hair 20 held by the apparatus 1 was small, and operation was easy and simple. In Comparative example 9, the first adhesive layers 4*a*, 4*b* were too thick. Due to this, if each of the apparatus 1 was folded double, then the monofilaments 3 were not sufficiently engaged with one another due to the thickness of the adhesive layers 4*a*, 4*b*, the adhesion between the user's natural hair 20 and each apparatus 1 was reduced, the fixing force was produced only by the adhesive layers 4*a* an 4*b*, and the sufficient fixing force was not generated. On the twelfth day since the user wore the wig 21, the portions in which the user's natural hair 20 was fixed loosened, the hair 20 came off, and the wearing state became unstable, so that the wig 21 was detached from the user's head. Further, similarly to Comparative example 1, it was difficult to widen the apparatus 1, the apparatus 1 was damaged while widening the apparatus 1, and it took long time to detach the user's natural hair 20 from the apparatus 1 using an organic solvent-based degloss.

In Comparative example 10, the adhesive force of the first adhesive layers 4*a*, 4*b* were very low. Due to this, on the fifth day the portions in which the user's natural hair 20 was fixed loosened, the hair 20 came off, and the wearing state became unstable. Then on seventh day the apparatus became opened and the wig 21 was detached from the user's head. In Comparative example 11, the adhesive force of the first adhesive layers 4*a*, 4*b* were strong and higher than that in Example 1. Due to this, similarly to Example 1, even on the 30th day the portions in which the user's natural hair 20 was fixed did not loosen and the fixing force hardly changed from that while the user wore the wig 21. However, it was not possible to widen the apparatus 1 because of strong adhesive force, the apparatus 1 was broken while forcibly widening the apparatus 1, and it took much more long time to detach the user's natural hair 20 from the apparatus 1 using an organic solvent-based degloss and further the user's head was damaged by an organic solvent-based degloss.

As can be understood, in Examples 1 to 3, the wig 21 could be fixed firmly and stably and could be detached easily because of the anchoring effect and the synergic effect of the first adhesive layers 4*a*, 4*b*. Namely, the monofilaments 3 of a predetermined shape at a predetermined height were arranged on the surface side on which the parts 20*a* and 20*b* of the user's natural hair 20 were pulled out onto and fixedly held by the apparatus 1, that is, on the first side of the flexible plane sheet 2 at predetermined intervals. By so arranging, the parts 20*a* and 20*b* of the user's natural hair 20 held by the apparatus 1 entered between the monofilaments 3 or held between the monofilaments 3, thus producing the anchoring effect. Furthermore, if the wig 21 was detached from the user's head, the first side of the flexible plane sheet 2 was in a roughened state by arranging the monofilaments 3 on the side on which the parts 20*a* and 20*b* of the user's natural hair 20 were pulled out onto and fixedly held by the apparatus 1 at predetermined intervals. Due to this, even if each apparatus 1 was folded double and the first half area 1*a* and the second half area 1*b* were attached closely, the apparatus 1 could be easily widened by reduction in the adhesive force of the first adhesive layers 4*a*, 4*b*.

Next, as the quantitative evaluation, a holding and fixing load of holding and fixing the user's natural hair 20 by one apparatus 1 and a release load in a state in which the apparatus 1 was folded double and bent with the first and second half areas 1*a* and 1*b* closely attached to each other were measured under the following conditions.

Measuring method: Single tensile measurement;

Measuring tool: Compact table-top universal tester "EZ Test" manufactured by Shimadzu Corporation; and Measuring conditions: Sample distance of 50 mm and tensile speed of 100 mm/min Measuring results of Examples 1 to 3 and Comparative examples 1 to 11 are shown in Table 2 below.

TABLE 2

| Items | Example 1 | Example 2 | Example 3 | Compar. Example 1 | Compar. Example 2 | Compar. Example 3 | Compar. Example 4 |
|---|---|---|---|---|---|---|---|
| Holding loads (kg) | 0.145 | 0.137 | 0.141 | 0.093 | 0.096 | 0.094 | 0.098 |
| Release lods (kg) | 2.76 | 2.74 | 2.77 | 4.31 | 3.88 | 2.21 | 2.76 |
| Items | Compar. Example 5 | Compar. Example 6 | Compar. Example 7 | Compar. Example 8 | Compar. Example 9 | Compar. Example | Compar. Example |
| Holding loads (kg) | 0.102 | 0.091 | 0.095 | 0.115 | 0.125 | 0.08 | 0.169 |
| Release lods (kg) | 3.05 | 2.50 | 2.16 | 1.96 | 4.42 | 1.57 | 5.21 |

The holding loads per natural hair by the apparatus 1 in Examples 1 to 3 were 137 g to 145 g. Those in Comparative examples 1 to 10 were 80 g to 125 g which were all lower than those in Examples 1 to 3, and that in Comparative example 11 was 169 g which was higher than those in Examples 1 to 3. Furthermore, the release loads in the state in which each apparatus 1 was folded double and bent with the first and second half areas 1*a* and 1*b* closely attached to each other in Examples 1 to 3 were 2.74 kg to 2.77 kg. Those in Comparative examples 1, 2, 5, 9 and 11 were 3.05 kg to 5.21 kg which exceeded those in Examples 1 to 3. That in Comparative example 4 was 2.76 Kg which was almost equivalent to those in Examples 1 to 3. Those in Comparative examples 3, 6, 7, 8 and 10 were 1.57 kg to 2.50 kg which were lower than those in Examples 1 to 3.

As indicated by results of measuring the functions of the apparatus 1 shown in the Table 2, the apparatus 1 in Examples 1 to 3 are high in the user's natural hair holding and fixing load and relatively low in the fixing apparatus release load. Due to this, the fixing force of fixing the user's natural hair 20 is strong, the wig 21 can be easily detached, and the balance between the natural hair fixing force and the wig detachment easiness is favorable. In Comparative examples 1 to 11, by contrast, the fixing apparatus release load is high while the user's natural hair holding and fixing load is low or both the user's natural hair holding and fixing load and the fixing apparatus release load are low, and the balance between the natural hair fixing force and the wig detachment easiness is unfavorable.

INDUSTRIAL APPLICABILITY

As stated so far, the apparatus and the method using the apparatus according to the present invention are effective since it is possible to wear and take off a wig easily and surely without straining user's scalp and user's hair and it is also possible to prevent the wig from floating to make the appearance unnatural while the user wears the wig.

The invention claimed is:

1. An apparatus for fixing a wig to head of a user, comprising:

a flexible plane sheet having a first opening and a second opening;

a plurality of monofilaments protrusively provided on a first side of the flexible plane sheet, each having a swollen head;

a first adhesive layer provided on the plurality of monofilaments;

a net member provided on a second side of the flexible plane sheet; and a second adhesive layer provided on the net member in substantially a whole range of a first half area sectioned by a line bisecting the flexible plane sheet, wherein the first opening is provided on the line so that a part of natural hair of the user passes through the first opening, and the second opening is provided at a predetermined position in a second half area sectioned by the line so that other part of the natural hair of the user passes through the second opening.

2. The apparatus according to claim 1, wherein each of the first opening and the second opening is a long hole having a length in the direction of the line, and the second opening is set to be smaller in size than the first opening.

3. The apparatus according to claim 1, wherein the first adhesive layer is provided in substantially the whole range of the first half area and a predetermined range surrounding the second opening.

4. A method for fixing a wig including a wig base and artificial hair to head of a user using the apparatus according to claim 1, the method comprising the steps of:

attaching a plurality of the apparatus to the wig by bonding each of the apparatus via the second adhesive layer to a predetermined position on a rear surface of the wig base;

pulling out a part of natural hair of the user through the first opening from the second side toward the first side of the flexible plane sheet;

pulling out other part of the natural hair of the user through the second opening from the second side toward the first side of the flexible plane sheet; and overlapping the first half area and the second half area with each other while the part and the other part of natural hair are held between the first half area and the second half area by folding one of the first half area and the second half area to the other in the direction of the first side, whereby the part and the other part of natural hair get entangled with each other and are engaged between the plurality of monofilaments on the first half area and the second half area, and this engaged state is kept by an adhesive force of the first adhesive layer.

* * * * *